US007490953B2

(12) United States Patent
Holten et al.

(10) Patent No.: US 7,490,953 B2
(45) Date of Patent: Feb. 17, 2009

(54) LAMPS AND REFLECTOR ARRANGEMENT FOR COLOR MIXING

(75) Inventors: Petrus Adrianus Josephus Holten, Winterswijk (NL); Paulus Gerardus Henricus Kosters, Winterswijk (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 27 days.

(21) Appl. No.: 10/599,860

(22) PCT Filed: Mar. 23, 2005

(86) PCT No.: PCT/IB2005/050998

§ 371 (c)(1),
(2), (4) Date: Oct. 12, 2006

(87) PCT Pub. No.: WO2005/100847

PCT Pub. Date: Oct. 27, 2005

(65) Prior Publication Data

US 2007/0195525 A1 Aug. 23, 2007

(30) Foreign Application Priority Data

Apr. 16, 2004 (EP) ..... 04101573

(51) Int. Cl.
*F21V 33/00* (2006.01)

(52) U.S. Cl. ..... 362/231; 362/219; 362/223; 362/238; 362/230

(58) Field of Classification Search ..... 362/217, 362/219, 222, 223, 225, 230, 231, 218, 238
See application file for complete search history.

(56) References Cited

U.S. PATENT DOCUMENTS

| | | | | | |
|---|---|---|---|---|---|
| 4,404,619 | A | * | 9/1983 | Ferguson | 362/222 |
| 4,418,378 | A | * | 11/1983 | Johnson | 362/97 |
| 4,490,777 | A | * | 12/1984 | Tanner et al. | 362/221 |
| 4,587,600 | A | * | 5/1986 | Morten | 362/219 |
| 5,394,314 | A | * | 2/1995 | Evanisko | 362/216 |
| 6,126,297 | A | * | 10/2000 | Matsui et al. | 362/231 |
| 2002/0172038 | A1 | | 11/2002 | Dicken et al. | |

FOREIGN PATENT DOCUMENTS

| | | | |
|---|---|---|---|
| DE | 19909630 | A1 | 9/1999 |
| DE | 19909630 | C2 | 9/1999 |
| EP | 0682209 | A2 | 11/1995 |
| EP | 0682209 | B1 | 11/1995 |
| EP | 0732540 | A2 | 9/1996 |
| EP | 0732540 | B1 | 9/1996 |
| EP | 08700977 | A2 | 10/1998 |
| FR | 1013380 | | 7/1952 |
| JP | 06150706 | A | 5/1994 |
| JP | 07085710 | A | 3/1995 |

(Continued)

*Primary Examiner*—Laura Tso

(57) ABSTRACT

A luminaire suitable for color mixing of light originating from lamps having different color properties has reflectors configured to provide an equal ratio of partial illuminance for each of the color properties at each position of a translucent element, e.g. a diffuser. This provides a uniform color mixing and/or the possibility of adjusting the color properties of the luminaire merely by adjusting the brightness of one or more of the lamps. The reflectors may include top reflectors, side reflectors and/or shielding reflectors positioned between the lamps and the exit window. The shielding reflectors may be configured to partly reflect and partly transmit light.

26 Claims, 4 Drawing Sheets

FOREIGN PATENT DOCUMENTS

| | | | |
|---|---|---|---|
| JP | 10074409 | A | 3/1998 |
| JP | 10321030 | A | 12/1998 |
| WO | 0216827 | A1 | 2/2002 |
| WO | 03071185 | A1 | 8/2003 |
| WO | 03071187 | A1 | 8/2003 |

* cited by examiner

LAMPS AND REFLECTOR ARRANGEMENT FOR COLOR MIXING

FIELD OF THE INVENTION

The present invention relates to a luminaire adapted to provide uniform color mixing of light originating from at least two lamps having different color properties.

BACKGROUND OF THE INVENTION

WO 02/16827 discloses a luminaire having a lamp housing accommodating lamps of different color aspects. The lamps are surrounded by a reflector and a non-transparent, light-transmitting window. In the lamp housing, light of different color or color temperature is mixed. The window gives access to a reflector housing where further mixing is provided. A disadvantage of the luminaire disclosed in WO 02/16827 is that the color mixing is not completely uniform. Another disadvantage is that the color of the light leaving the luminaire can not be adjusted without affecting the uniformity of the color mixing.

SUMMARY OF THE INVENTION

It is an object of the present invention to provide a luminaire which provides a uniform color mixing.

It is a further object of the invention to provide a luminaire in which the color of the light leaving the luminaire may be adjusted without affecting the uniformity of the color mixing.

According to a first aspect of the present invention the above and other objects are fulfilled by providing a luminaire comprising:

electrical contacting means for accommodating at least two lamps, at least one of said lamps having first color properties, and at least one of said lamps having second color properties, said second color properties being different from said first color properties, an exit window adapted to allow light to pass from the interior of the luminaire to the exterior of the luminaire, a translucent element positioned between the lamps and the exit window, and one or more reflectors configured to guide light from each of the lamps to the translucent element in such a way that equal ratio of partial illuminance for each of the color properties is created at each position of the translucent element.

According to a second aspect of the present invention the above and other objects are fulfilled by providing an array of luminaires, wherein at least one of the luminaires in the array is a luminaire according to the first aspect of the invention.

Due to the fact that the reflectors are configured to guide light from each of the lamps to the translucent element in such a way that equal ratio of partial illuminance for each of the color properties is created at each position of the translucent element, a very uniform color mixing is obtained. Furthermore, this feature also has the effect that the color appearance of the light which leaves the luminaire can be easily changed, merely by changing the brightness of one or more of the lamps, since this only affects the ratio of the color properties, and not the uniformity.

The reflector(s) should be shaped and positioned in such a way that light having specific color properties is reflected away from regions where light with those color properties is likely to be overrepresented and towards regions where light with those color properties is likely to be underrepresented, thereby ensuring a uniform color distribution.

The first and/or the second color properties may, e.g., comprise primary colors and/or comprise color temperature, for example as a first color property a cool color temperature of about 6500K and as a second color property a warm color temperature of about 2700 K, or vice versa. It may also comprise brightness and/or any other suitable properties, as long as the luminaire comprises at least two lamps with different color properties, and the light from these at least two lamps needs to be mixed in order to create light from the luminaire with desired color properties.

The one or more reflectors preferably comprise at least one reflector positioned in such a way that at least one of the lamps is between said reflector and the translucent element. If the luminaire is positioned on a ceiling such a reflector is, thus, positioned above at least one of the lamps, i.e. it is a top reflector. Such reflectors ensure that light emitted upwards from the lamps is reflected, directly or indirectly, towards the exit window.

Alternatively or additionally, the one or more reflectors may comprise at least one reflector positioned in such a way that it is adapted to reflect light emitted by at least one of the lamps in a direction substantially transversal to the direction between said lamp and the translucent element. Such a reflector is normally positioned next to one or more of the lamps, i.e. a side reflector.

Alternatively or additionally, the one or more reflectors may comprise at least one shielding reflector positioned between at least one of the lamps and the translucent element, or still alternatively that at least a part of the translucent element is shielded by the reflector from a lamp axis of at least one of the lamps. This is particularly useful in case there are regions of the translucent element where one or more lamps having specific color properties is/are much closer than the lamp(s) having other color properties. In this case it may be necessary to shield the closer lamp(s) because the contribution from the closer lamp(s) in this region would otherwise be far too large.

The shielding reflector may be configured to partially transmit light and partially reflect light. This may, e.g., be achieved by the shielding reflector having a non-straight edge in a longitudinal direction, e.g. a saw-tooth shape of the shielding reflector. Alternatively or additionally, it may be achieved by means of a coating providing the partial transmission and the partial reflection of the light and/or by means of the shielding reflector being provided with a perforation, said perforation providing the partial transmission and the partial reflection of the light.

The shielding reflector may provide a ratio between partial transmission and partial reflection which varies across the reflector. This also contributes to the equal ratio of partial illuminance of the translucent element.

The shielding reflector may have the geometry of a fyke, thereby being adapted to guide at least some light into a region between the shielding reflector and the translucent element. Thereby it is ensured that no shadow effects are created by the shielding reflector.

Preferably, the translucent element comprises a diffusor which may have Lambertian properties. The diffusor may form an integral part of the exit window, i.e. the exit window itself may be diffusive. Alternatively, the diffusor may be a separate element positioned between at least one of the lamps and the exit window.

Alternatively, the translucent element may comprise a transparent panel with an optical structure to direct light, such as lenses or prisms.

The luminaire may further be provided with one or more openings formed in a part of the luminaire being positioned substantially opposite the exit window. These openings may be used to direct light towards the ceiling to achieve also an indirect lighting component. In an advantageous embodiment the opening(s) has/have an elongated shape and is/are arranged with the longitudinal dimension in a transversal direction of the luminaire. Thus, they may be rectangular openings which are transversely arranged in a top reflector. By arranging the openings transversely with respect to the lamps the reflector function for the illuminance balance onto the translucent element is maintained. Longitudinal openings would have the disadvantage to take away only some light source images while other images remain, thus introducing a non-balance of the various color properties.

The at least two lamps may be arranged substantially in a plane which may be arranged substantially parallel to a plane defined by the exit window or substantially perpendicular to such a plane. In the first case the lamps are arranged side by side, and in the other case the lamps are arranged above each other.

Preferably, at least one of the lamps is a fluorescent lamp. However, one or more of the lamps may be any other suitable kind of lamp, such as a light emitting diode.

In a preferred embodiment the color of the light emitted from the luminaire via the exit window is adjustable by means of adjusting the brightness of the individual lamps. As described above, this is actually achieved by the special configuration of the reflectors.

In one embodiment the maximum combined light flux originating from all lamps having first color properties is different from the maximum combined light flux originating from all lamps having second color properties. This may, e.g., be achieved by having one 'cool' lamp and two 'warm' lamps, or by having one high output 'warm' lamp and one low output 'cool' lamp. This deliberate difference has the effect that the light leaving the luminaire has desired color properties, and that these color properties can be adjusted to meet the demands and whishes of the user.

These and other aspects of the invention will be apparent from and elucidated with reference to the embodiments described hereinafter.

BRIEF DESCRIPTION OF THE DRAWINGS

The invention will now be described with reference to the accompanying drawings in which.

DESCRIPTION OF PREFERRED EMBODIMENTS

Figure 1:
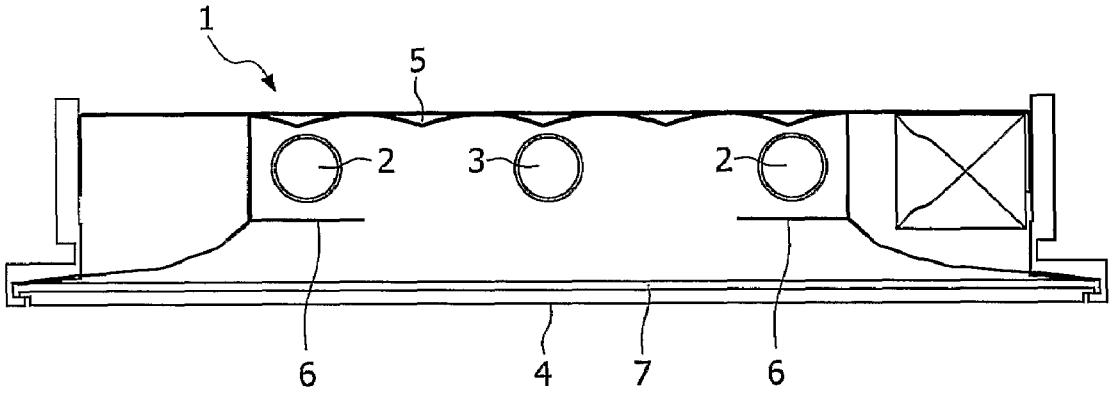
FIG. 1 is a luminaire section of an embodiment comprising three lamps.

FIG. 1 shows a luminaire 1 accommodating two lamps 2 which generate cool light and one lamp 3 which generates warm light. The lamps 2, 3 are arranged side by side with the one generating warm light 3 being arranged between the two generating cool light 2. This configuration ensures that there is symmetry in color perception of the light leaving the luminaire. The luminaire 1 further comprises an exit window 4 which acts as a diffusor, and a translucent element 7 which is positioned between the lamps 2, 3 and the exit window 4. Furthermore, the luminaire 1 comprises a top reflector 5 which reflects light emitted from the lamps 2, 3. The top reflector 5 has such a shape that the light is reflected onto the exit window 4 in such a way that equal ratio of partial illuminance for each of the warm and cool colors is created at each position of the exit window 4. Thereby a very uniform color distribution is provided. The luminaire also comprises two shielding reflectors 6 positioned below the lamps 2 which generate cool light. The function of these shielding reflectors 6 will be further described below.

Figure 2:
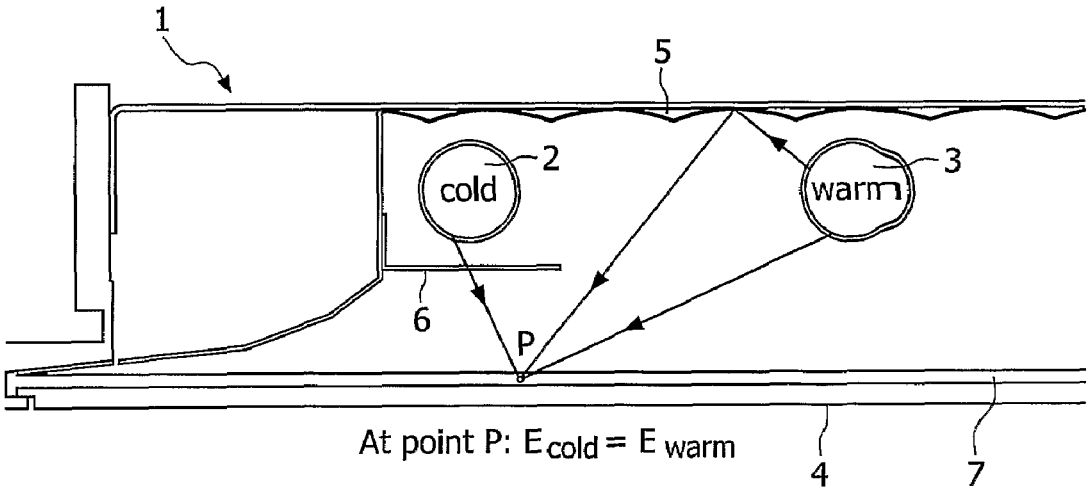
FIG. 2 is a detail of the luminaire of FIG. 1 illustrating the creation of an equal ratio of partial illuminance for the different colors on each position of a diffusor.

FIG. 2 is a detail of the luminaire 1 of FIG. 1, illustrating the creation of an equal ratio of partial illuminance for the different colors on each position of the exit window 4. As illustrated, point P, positioned on the translucent element 7, receives light directly from the warm lamp 3, light emitted from the warm lamp 3 and reflected by the top reflector 5, and light from the cool lamp 2 via the shielding reflector 6. The shielding reflector 6 is necessary in order to reduce the amount of light received from the cool lamp 2 at point P, because the cool lamp 2 is much closer to point P than the warm lamp 3. Furthermore, the reflection by the top reflector 5 ensures that additional light from the warm lamp 3 is directed towards point P in order to compensate for the further distance. Thus, by configuring the reflectors 5, 6 in an appropriate manner, it can be ensured that each point at the exit window 4 is illuminated with an equal ratio of partial illuminance for the different colors. Furthermore, because this is achieved by means of the reflector arrangement, the color appearance can be changed by changing the brightness of one or more of the lamps 2, 3.

Figure 3:
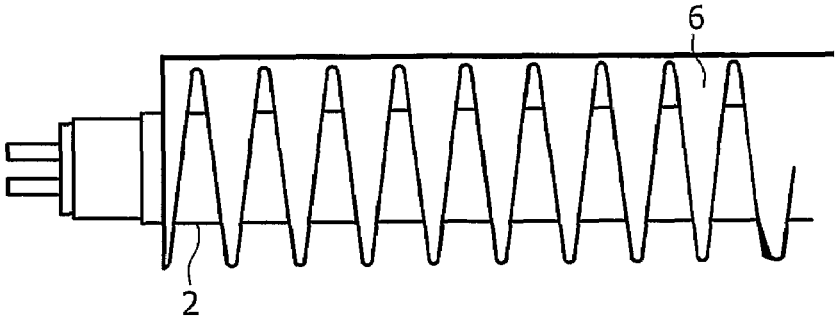
FIG. 3 shows a special saw-tooth reflector positioned below one of the lamps.

FIG. 3 shows a shielding reflector 6 positioned below a lamp 2. The shielding reflector 6 has a special saw-tooth shape which reduces the illuminance from the lamp 2 onto the exit window 4 since some of the light from the lamp 2 will be reflected and some of the light will be allowed to pass, due to the shape of the shielding reflector 6. Thereby illuminance balance with other colors is achieved, in particular at points where the illuminance originating from the lamp 2 would otherwise be too high.

Figure 4:
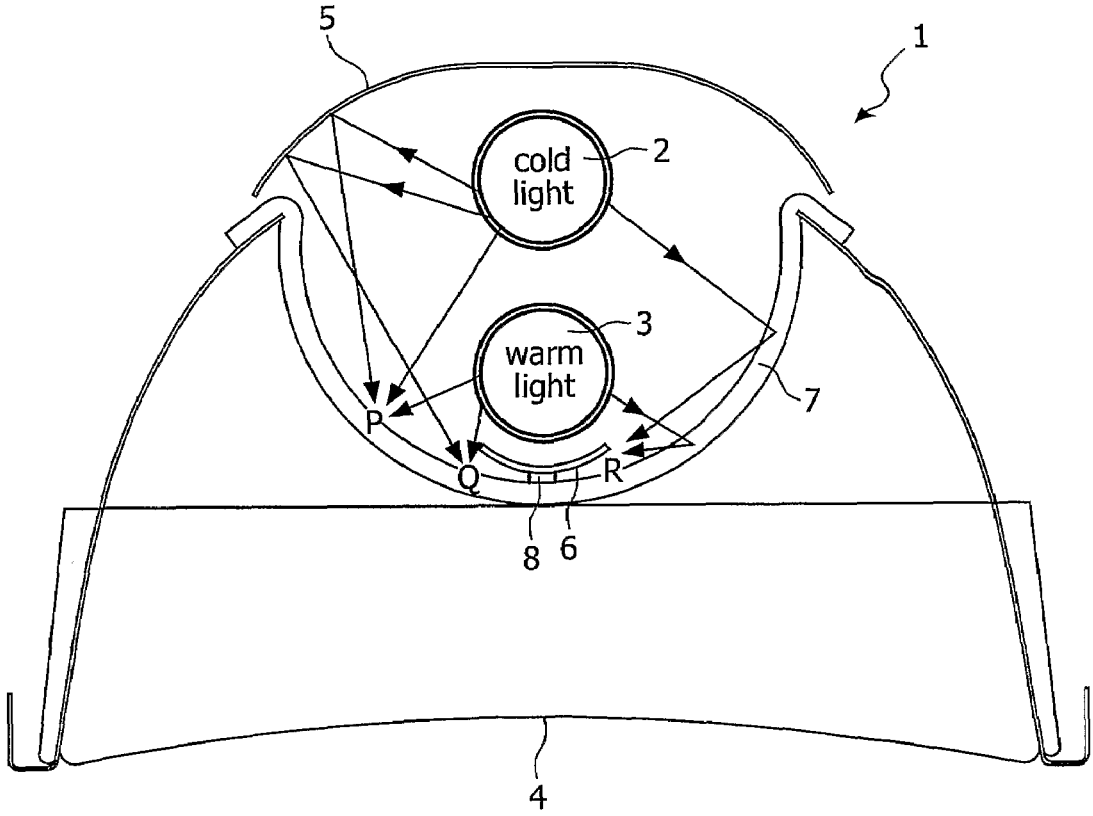
FIG. 4 is a luminaire of an embodiment comprising two lamps.

FIG. 4 shows a luminaire 1 according to another embodiment of the invention. The luminaire 1 according to this embodiment comprises one lamp 2 which generates cool light and one lamp 3 which generates warm light. The lamps 2, 3 are arranged with the cool lamp 2 above the warm lamp 3. In this embodiment, the luminaire 1 is provided with a separate translucent element 7 and which acts as a diffusor and which is positioned between the lamps 2, 3 and the exit window 4. Due to the fact that the cool lamp 2 is positioned above the warm lamp 3, the warm lamp 3 is considerably closer to the diffusor 7, in particular the center part of the diffusor 7. Furthermore, the warm lamp 3 blocks the light from the cool lamp 2 in this region. Therefore, it is necessary to provide a shielding reflector 6 below the warm lamp 3 in order to create an equal ratio of partial illuminance for the different colors in the center region of the diffusor 7.

Furthermore, the shielding reflector 6 is positioned with a distance to the diffusor 7 by means of a distant holder 8 in order to allow reflected light to enter the region between the shielding reflector 6 and the diffusor 7. Thereby sufficient brightness is provided to the corresponding part of the diffusor 7. The shielding reflector 6 and the diffusor 7 are shaped in such a way that they together form the geometry of a fyke. The shielding reflector 6 is sufficiently reflective on both sides to achieve this. In order to provide sufficient brightness to the most central part of the diffusor 7, the distant holder 8 is transparent, so that light is also admitted to this region.

The diffusor 7 is configured to partly transmit and partly reflect light as a white reflector. Thus, the diffusor 7 actively helps in mixing the colors and in directing light to desired regions, e.g. the region between the shielding reflector 6 and the diffusor 7.

Figure 5:
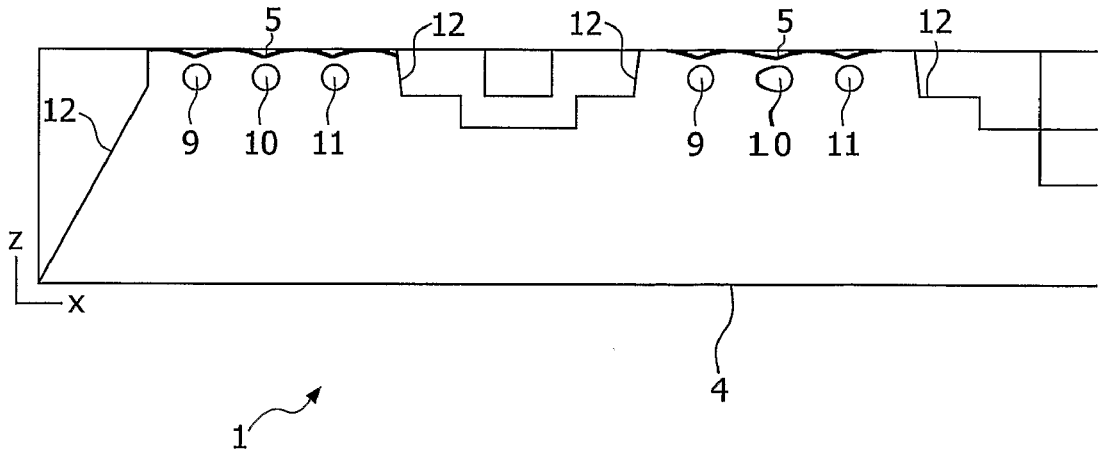
FIG. 5 is a luminaire of an embodiment comprising six lamps.
Figure 6:
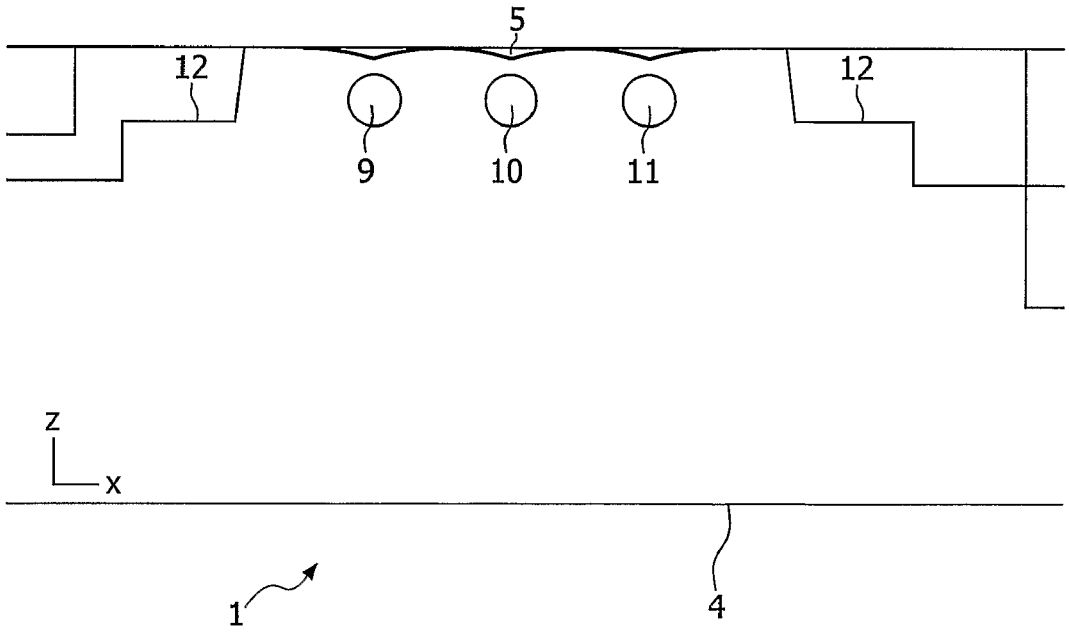
FIG. 6 is a detail of the luminaire of FIG. 5.

FIGS. 5 and 6 show another embodiment of the present invention, in which two lamps 9 emitting red light, two lamps 10 emitting green light and two lamps 11 emitting blue light are positioned side by side in a luminaire 1. Thus, in this embodiment the different color properties of the lamps 9, 10, 11 are the different primary colors. FIG. 6 is a detail of FIG. 5. The luminaire 1 further comprises an exit window 4 functioning as a diffusor, and a top reflector 5. The green lamps 10 are positioned symmetrically in the luminaire 1 while the red lamps 9 and the blue lamps 11 are positioned asymmetrically. The red lamps 9 and the blue lamps 11 block the light from the green lamps 10 emitted in their direction. Thereby the lamps 9, 11 actively help in achieving a uniform color distribution at the exit window 4. However, the light from the red lamps 9 and the blue lamps 11, respectively, is only blocked by the green lamps 9, and only in one direction. Thus, in order to ensure a uniform color distribution, the luminaire 1 is provided with special side reflectors 12 which are shaped in such a way that the light emitted sideways from the red lamps 9 and the blue lamps 11 is not only blocked, but also directed towards a region where this light is desired in order to provide a uniform color distribution at the exit window 4. The side reflectors 12 are preferably white in order to get less shadow effects on the exit window 4, and in order to spread the light reflected on the exit window 4.

Figure 7:
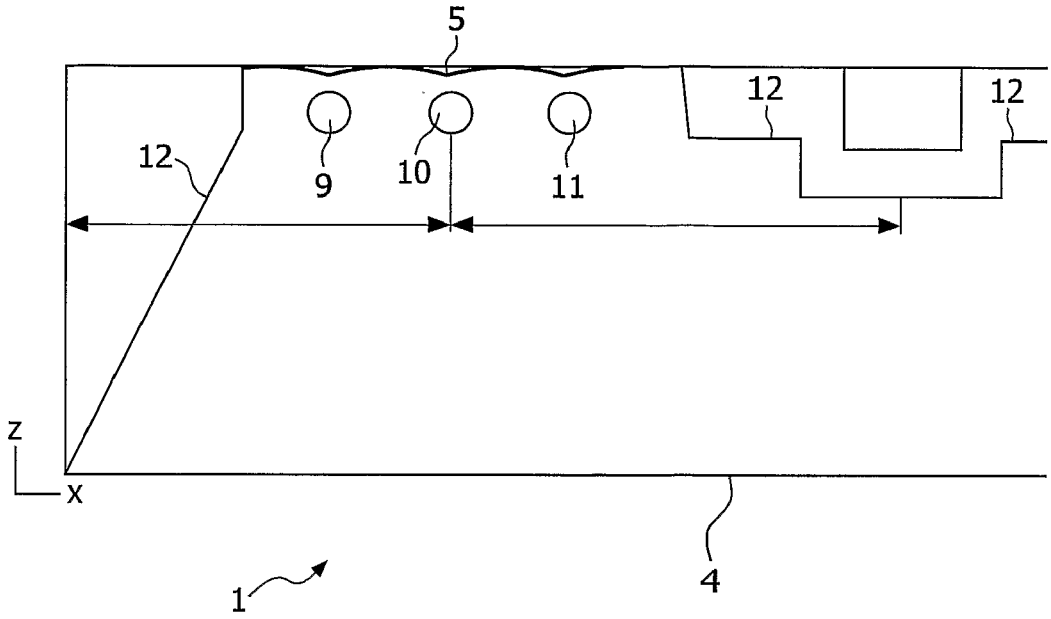
FIG. 7 is a detail of the luminaire of FIG. 5 illustrating the mutual positioning of the lamps.

FIG. 7 is another detail of FIG. 5 illustrating the mutual position of the lamps 9, 10, 11 in the luminaire 1. In order to obtain a uniform luminance level at the edge of the luminaire 1 (e.g. in order to allow several luminaires 1 to be placed next to each other), the green lamps 10 are positioned closer to the sides of the luminaire 1 than to the half distance to the next green lamp 10. In order to further increase the uniformity at the exit window 4, further reflectors may be positioned at or near the side reflectors 12 and/or the top reflector 5, in order to further reflect the light from the red lamps 9 and/or the blue lamps 11, and/or to guide this light towards desired regions. The uniformity may be even further increased by diminishing the transmittance of the exit window 4 to approximately 30%. Thereby more light is reflected by the exit window 4, and this reflected light almost always reflects on another white surface before reaching the exit window 4 again, thereby achieving an improved spreading of the light. So by decreasing the transmittance the amount of light that is not reflected by the exit window 4 is diminished and the amount of light that is reflected at least once (and has a uniform spread) is increased. In this way the luminance level that is observed is uniform for the human eye.

Figure 8:
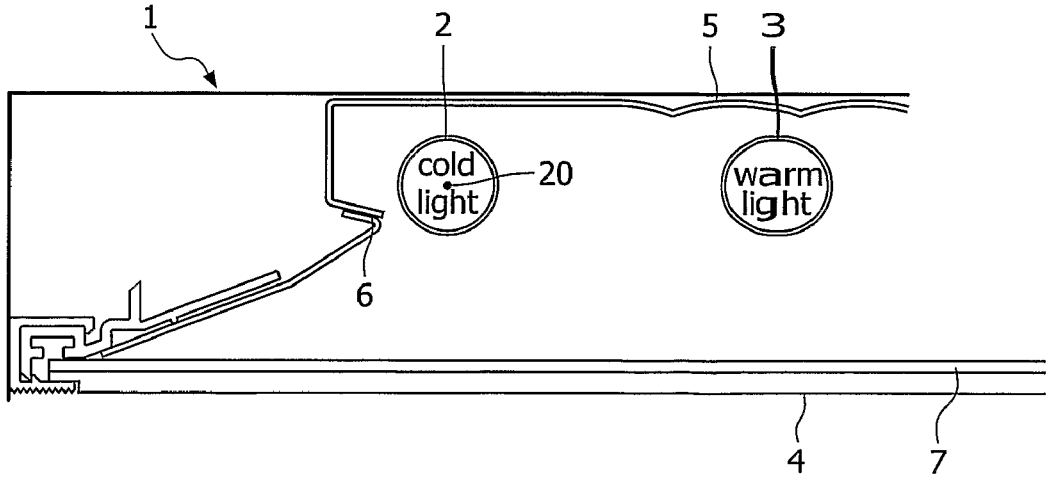
FIG. 8 is a detail of a further embodiment of the luminaire according to the invention.

FIG. 8 is a detail of a further embodiment of a luminaire 1 according to the invention. The lamps 2, 3 are arranged side by side in the same order as shown in FIG. 1. This configuration ensures that there is symmetry in color perception of the light leaving the luminaire. The lamp 2 has a lamp axis 20. The luminaire 1 further comprises an exit window 4, which acts as a diffusor and a translucent element 7, which is positioned between the lamps 2, 3 and the exit window 4. Furthermore, the luminaire 1 comprises a top reflector 5, which reflects light emitted from the lamps 2, 3. The top reflector 5 has such a shape that the light is reflected onto the exit window 4 in such a way that equal ratio of partial illuminance for each of the warm and cool colors is created at each position of the exit window 4. Thereby a very uniform color distribution is provided. The luminaire also comprises at least one shielding reflector 6 in the neighborhood of the lamps 2. The reflector 6 is positioned in such a way that a part of the translucent element 7 is shielded from the respective lamp axis 20 of the lamp 2 by the respective reflector 6. Hence, this embodiment shows another possibility of an arrangement of the reflectors 5, 6 via which it can be ensured that each point at the exit window 4 is illuminated with an equal ratio of partial illuminance for the different colors. Furthermore, because this is achieved by means of the reflector arrangement, the color appearance can be changed by changing the brightness of one or more of the lamps 2, 3.

Although the present invention has been described in connection with the preferred embodiments, it is not intended to be limited to the specific form set forth herein. Rather, the scope of the present invention is limited only by the accompanying claims. In the claims, the term comprising does not exclude the presence of other elements or steps. Additionally, although individual features may be included in different claims, these may possibly be advantageously combined, and the inclusion in different claims does not imply that a combination of features is not feasible and/or advantageous. In addition, singular references do not exclude a plurality. Thus, references to "a", "an", "first", "second" etc. do not preclude a plurality. Furthermore, reference signs in the claims shall not be construed as limiting the scope.

The invention claimed is:

1. A luminaire comprising:

electrical contacting means for accommodating at least two lamps, at least one of said lamps having first color properties, and at least one of said lamps having second color properties, said second color properties being different from said first color properties, an exit window adapted to allow light to pass from the interior of the luminaire to the exterior of the luminaire, a translucent element positioned between the lamps and the exit window, and at least one reflector configured to guide light from each of the lamps to the translucent element in such a way that equal ratio of partial illuminance for each of the color properties is created at each position of the translucent element.

2. The luminaire according to claim 1, wherein at least one of the first and the second color properties comprise color temperature.

3. The luminaire according to claim 1, wherein at least one of the first and the second color properties comprise primary colors.

4. The luminaire according to claim 1, wherein the at least one reflector comprises a reflector positioned in such a way that at least one of the lamps is between said reflector and the translucent element.

5. The luminaire according to claim 1, wherein the at least one reflector comprises a reflector positioned in such a way that it is adapted to reflect light emitted by at least one of the lamps in a direction substantially transversal to the direction between said lamp and the translucent element.

6. The luminaire according to claim 1, wherein the at least one reflector comprises a shielding reflector positioned between at least one of the lamps and the translucent element.

7. The luminaire according to claim 1, wherein the at least one reflector comprises a shielding reflector positioned in such a way that at least a part of the translucent element is shielded by the shielding reflector from a respective lamp axis of the at least one lamp.

8. The luminaire according to claim 6, wherein the shielding reflector is configured to partially transmit light and partially reflect light.

9. A luminaire comprising:

electrical contacting means for accommodating at least two lamps, at least one of said lamps having first color properties, and at least one of said lamps having second color properties, said second color properties being different from said first color properties, an exit window adapted to allow light to pass from the interior of the luminaire to the exterior of the luminaire, a translucent element positioned between the lamps and the exit window, and at least one reflector configured to guide light from each of the lamps to the translucent element, wherein the at least one reflector has a non-straight edge in a longitudinal direction.

10. The luminaire according to claim 8, wherein the shielding reflector has a coating providing the partial transmission and the partial reflection of the light.

11. A luminaire comprising:

electrical contacting means for accommodating at least two lamps, at least one of said lamps having first color properties, and at least one of said lamps having second color properties, said second color properties being different from said first color properties, an exit window adapted to allow light to pass from the interior of the luminaire to the exterior of the luminaire, a translucent element positioned between the lamps and the exit window, and at least one reflector configured to guide the light from each of the lamps to the translucent element, wherein the at least one reflector is provided with a perforation, said perforation providing partial transmission and partial reflection of the light.

12. A luminaire comprising:

electrical contacting means for accommodating at least two lamps, at least one of said lamps having first color properties, and at least one of said lamps having second color properties, said second color properties being different from said first color properties, an exit window adapted to allow light to pass from the interior of the luminaire to the exterior of the luminaire, a translucent element positioned between the lamps and the exit window, and at least one reflector configured to guide the light from each of the lamps to the translucent element, wherein the at least one reflector provides a ratio between partial transmission and partial reflection, said ratio varying across the at least one reflector.

13. The luminaire according to claim 6, wherein the shielding reflector is adapted to guide at least some light into a region between the shielding reflector and the translucent element.

14. The luminaire according to claim 1, wherein the translucent element comprises a diffuser.

15. The luminaire according to claim 14, wherein the diffusor has Lambertian properties.

16. The luminaire according to claim 14, wherein the diffuser forms an integral part of the exit window.

17. The luminaire according to claim 1, wherein the translucent element comprises a transparent panel with an optical structure to direct light.

18. A luminaire comprising:

electrical contacting means for accommodating at least two lamps, at least one of said lamps having first color properties, and at least one of said lamps having second color properties, said second color properties being different from said first color properties, an exit window adapted to allow light to pass from the interior of the luminaire to the exterior of the luminaire, a translucent element positioned between the lamps and the exit window, and at least one reflector configured to guide the light from each of the lamps to the translucent element, the luminaire further being provided with at least one opening formed in a part of the luminaire being positioned substantially opposite the exit window.

19. The luminaire according to claim 18, wherein the at least one opening has an elongated shape and is arranged with the longitudinal dimension in a transversal direction of the luminaire.

20. The luminaire according to claim 1, wherein the at least two lamps are arranged substantially in a plane.

21. The luminaire according to claim 20, wherein the plane is arranged substantially parallel to a plane defined by the exit window.

22. The luminaire according to claim 20, wherein the plane is arranged substantially perpendicular to a plane defined by the exit window.

23. The luminaire according to claim 1, wherein at least one of the lamps is a fluorescent lamp.

24. The luminaire according to claim 1, wherein the color of the light emitted from the luminaire via the exit window is adjustable by means of adjusting the brightness of the individual lamps.

25. The luminaire according to claim 1, wherein the maximum combined light flux originating from all lamps having first color properties is different from the maximum combined light flux originating from all lamps having second color properties.

26. An array of luminaires, wherein at least one of the luminaires in the array is a luminaire according to claim 1.

* * * * *